US009169665B1

(12) United States Patent
Zhou et al.

(10) Patent No.: US 9,169,665 B1
(45) Date of Patent: Oct. 27, 2015

(54) PUSHROD-TYPE TENT FRAME

(71) Applicants: Nanqing Zhou, Xiamen (CN); Ming Chen, Xiamen (CN); Muhua Mao, Xiamen (CN)

(72) Inventors: Nanqing Zhou, Xiamen (CN); Ming Chen, Xiamen (CN); Muhua Mao, Xiamen (CN)

(73) Assignee: Q-YIELD OUTDOOR GEAR LTD., Xiamen, Fujian (CN)

( * ) Notice: Subject to any disclaimer, the term of this patent is extended or adjusted under 35 U.S.C. 154(b) by 0 days.

(21) Appl. No.: 14/325,362

(22) Filed: Jul. 7, 2014

(51) Int. Cl.
*E04H 15/48* (2006.01)
*E04H 15/46* (2006.01)

(52) U.S. Cl.
CPC ..... *E04H 15/46* (2013.01); *E04H 15/48* (2013.01)

(58) Field of Classification Search
CPC ..... E04H 15/48; E04H 15/34; E04H 15/44; E04H 15/36
USPC ..... 135/121–124, 120.1, 120.3, 138, 144, 135/147, 151–154, 88.14, 137, 139, 148
See application file for complete search history.

(56) References Cited

U.S. PATENT DOCUMENTS

| | | | | | |
|---|---|---|---|---|---|
| 2,546,730 | A * | 3/1951 | Dickerson | ..... | 280/19.1 |
| 3,027,189 | A * | 3/1962 | Scott | ..... | 297/184.14 |
| 3,489,452 | A * | 1/1970 | Plante | ..... | 296/161 |
| 4,653,800 | A * | 3/1987 | Myers | ..... | 296/160 |
| 4,748,995 | A * | 6/1988 | Viglione | ..... | 135/130 |
| 7,090,286 | B1 * | 8/2006 | Foreth et al. | ..... | 296/173 |
| 2012/0042920 | A1 * | 2/2012 | Armstrong et al. | ..... | 135/153 |

* cited by examiner

*Primary Examiner* — Winnie Yip

(57) ABSTRACT

A pushrod-type tent frame includes a base, a frame linkage and a controlling mechanism. The frame linkage has two support sets arranged in parallel, each having a supporting pole, an upper supporting pole and a lower supporting pole pivotally connected in sequence. The supporting pole has an outer end pivotally connected to a front edge of the base, and the lower supporting pole has an outer end pivotally connected to a rear edge of the base. The controlling mechanism has two rod-pushing mechanisms pivotally connected to the two support sets, respectively. Each of the rod-pushing mechanisms has a driving device for driving a telescopic rod assembly to change its reach and thereby prop up or release the frame linkage, so as to expand the tent frame or allow the tent frame to be retracted.

5 Claims, 4 Drawing Sheets

PUSHROD-TYPE TENT FRAME

BACKGROUND OF THE INVENTION

1. Technical Field

The present invention generally relates to tents, and more particularly to a pushrod-type tent frame.

2. Description of Related Art

The increasing popularization of private cars has made self-drive tours an emerging type of tourism. Given this trend, the relevant manufacturers are increasingly competing to develop vehicle accessories for accommodating people who love self-drive tours. In this context, various rooftop tents have been developed among others.

A rooftop tent refers to a tent designed to be put up on a car roof and is considered more comfortable than traditional tents that are built directly on the ground and tend to be invaded by the cold, damp air from the ground. The conventional rooftop tents typically have a tent frame composed of multiple interconnected poles that are pivotally connected to each other via joints. To hold the tent at its expanded position, fixing members are deployed around the joints. Thus, when putting up and taking down the conventional rooftop tents, people have to perform operation at each of the joints and fixing members, making the process quite inconvenient and time-consuming.

For improving the conventional rooftop tents, semi-automatic and fully-automatic rooftop tents have been introduced, such as the automatic tent frame of China Patent No. 201120240226.0 invented by the same inventor as the present invention. Referring to FIG. 1, the very prior-art tent frame has an intermediate supporting pole 23' that is controllable to slide along its base, and implements a traction rope 31' with a free end thereof connected to the lower end of the intermediate supporting pole 23', so that when a driving device drives a rope windlass 32' to release or roll up the traction rope 31', the tent frame can be expanded or retracted. However, in this known tent frame, the traction rope 31' has a relatively long path, leaving the exposed traction rope 31' highly risky to malfunction. Thus, the existing automatic tent frame still needs to be improved.

SUMMARY OF THE INVENTION

In view of the need, the present invention, with the aim to remedy the shortcomings of the existing devices, herein provides a pushrod-type tent frame that has simplified structure and enhanced stability as well as reliability.

The technical scheme implemented by the present invention is providing a pushrod-type tent frame that comprises a base, a frame linkage and a controlling mechanism; the frame linkage including two support sets arranged at two lateral edges of the base and parallel to each other, each of the two support sets having a supporting pole, an upper supporting pole, and a lower supporting pole that are pivotally connected in sequence, the supporting pole having an outer end pivotally connected to a front edge of the base and the lower supporting pole having an outer end pivotally connected to a rear edge of the base. Therein, the controlling mechanism includes two rod-pushing mechanisms pivotally connected to the two support sets, respectively. Each said rod-pushing mechanism includes a driving device, and has one end pivotally connected to one said lateral edge of the base and an opposite end pivotally connected to the upper supporting pole or the lower supporting pole.

Therein, the rod-pushing mechanism comprises a fixed sleeve, a pushing rod received in the fixed sleeve for telescopic movement, and a driving device for driving the pushing rod to move with respect to the fixed sleeve.

Therein, the fixed sleeve has a lower end pivotally connected to the base via a holder, and the pushing rod has an upper end pivotally connected to the upper supporting pole or the lower supporting pole via a connecting member.

Therein, the fixed sleeve has a lower end pivotally connected to the base via a holder, and the pushing rod has an upper end pivotally connected to a pivot module that pivotally connects the lower supporting pole and the upper supporting pole.

Therein, the frame linkage the frame linkage comprises an auxiliary supporting pole that is a U-shaped member with two ends thereof unidirectionally, pivotally connected to the upper supporting poles, respectively.

Therein, the frame linkage comprises an auxiliary supporting pole that is a U-shaped member with two ends thereof unidirectionally, pivotally connected to two pivot modules each pivotally connecting the lower supporting pole and the upper supporting pole.

With the aforementioned scheme, the present invention the present invention has the rod-pushing mechanism that has the driving device to be pivotally connected to and control each of the two support sets of the tent frame, so as to expand or retract the tent frame by changing the reach of the telescopic rod assembly, i.e. the controlling mechanism or the rod-pushing mechanisms, so the rooftop tent frame is structurally simpler than the existing devices. Moreover, as compared to the prior-art mechanisms, the telescopic rod assembly of the present invention has its path much shorter and has its structural strength improved, so as to ensure the stability and reliability of the pushrod-type tent frame in terms of performance.

DETAILED DESCRIPTION OF THE INVENTION

Figure 1:
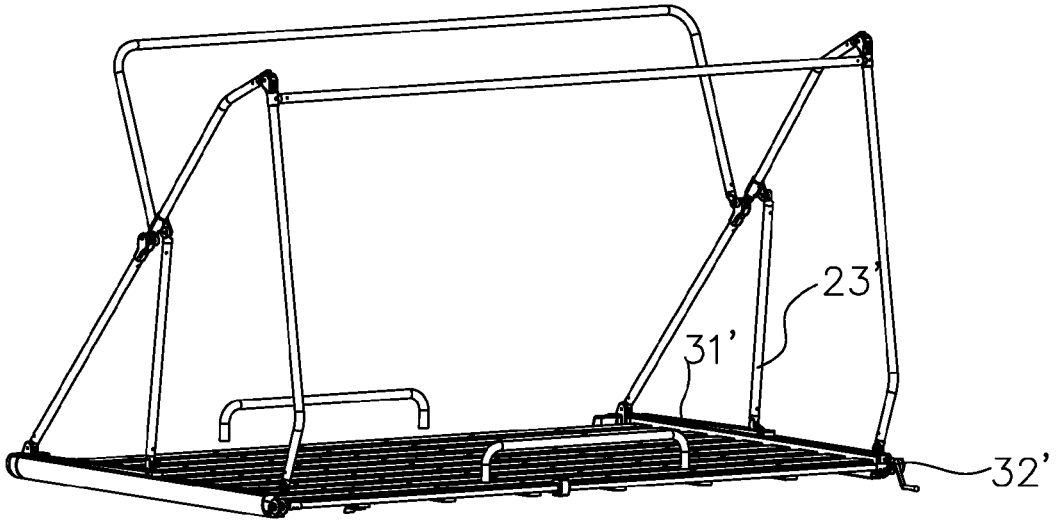
F I G. 1 Prior Art
FIG. 1 shows a conventional tent frame expanded.

For further illustrating the means and functions by which the present invention achieves the certain objectives, the following description, in conjunction with the accompanying drawings and preferred embodiments, is set forth as below to illustrate the implement, structure, features and effects of the subject matter of the present invention.

The present invention discloses a pushrod-type tent frame. Please refer to FIG. 2 through FIG. 7 for a preferred embodiment of the present invention. As shown, the disclosed tent frame comprises a base 1, a frame linkage 2 and a controlling mechanism.

The base 1 is a framework designed to be settled on the round or a car roof.

The frame linkage 2 includes two support sets 20 arranged along two lateral edges of the base 1 and parallel to each other. The two support sets 20 are connected by a reinforcing transverse bar 24. Each of the two support sets 20 includes a supporting pole 21, an upper supporting pole 22 and a lower supporting pole 23 that are pivotally connected in sequence. The supporting pole 21 has its outer end pivotally connected to a front edge of the base 1, while the lower supporting pole 23 has its outer end pivotally connected to a rear edge of the base 1, so that the base 1, the supporting pole 21 and the upper supporting pole 22, as well as the lower supporting pole 23, jointly form a rough triangle when the tent frame is fully put up.

The present invention features that the controlling mechanism has two rod-pushing mechanisms 3 pivotally connected to the two support sets 20, respectively. Each of the rod-pushing mechanisms 3 includes a driving device and has one end pivotally connected to one of the lateral edges of the base 1 and an opposite end pivotally connected to the upper supporting pole 22 or the lower supporting pole 23.

Each of the rod-pushing mechanisms 3 comprises a fixed sleeve 31, a pushing rod 32 received in the fixed sleeve 31 for telescopic movement, and a driving device 33 for driving the pushing rod 32 to move with respect to the fixed sleeve 31. In the present embodiment, the driving device 33 is deposited at the lower part of the fixed sleeve 31 and is an electric machine. The fixed sleeve 31 has its lower end pivotally connected to the base 1 via a holder 34. The pushing rod 32 has its upper end pivotally connected to the upper supporting pole 22 or the lower supporting pole 23 via a connecting member 35, or is pivotally connected to a pivot module where the lower supporting pole 23 and the upper supporting pole 22 are pivotally connected to each other.

The frame linkage 2 further comprises an auxiliary supporting pole 25. The auxiliary supporting pole 25 is a U-shaped member that has two ends unidirectionally, pivotally connected to the upper supporting poles 22, respectively, or pivotally connected to the pivot module where the lower supporting pole 23 and the upper supporting pole 22 are pivotally connected to each other, so as to fully expand the tent frame and thereby the tent roof. The unidirectional, pivotal connection refers to that the auxiliary supporting pole 25 is restricted to rotate against the upper supporting pole 22 for a preset angular range. In the present embodiment, the preset angular range is almost 90 degrees. It is to be noted that if the angular range were set too large, the tent frame would be unable to fully put up the tent roof.

Figure 2:
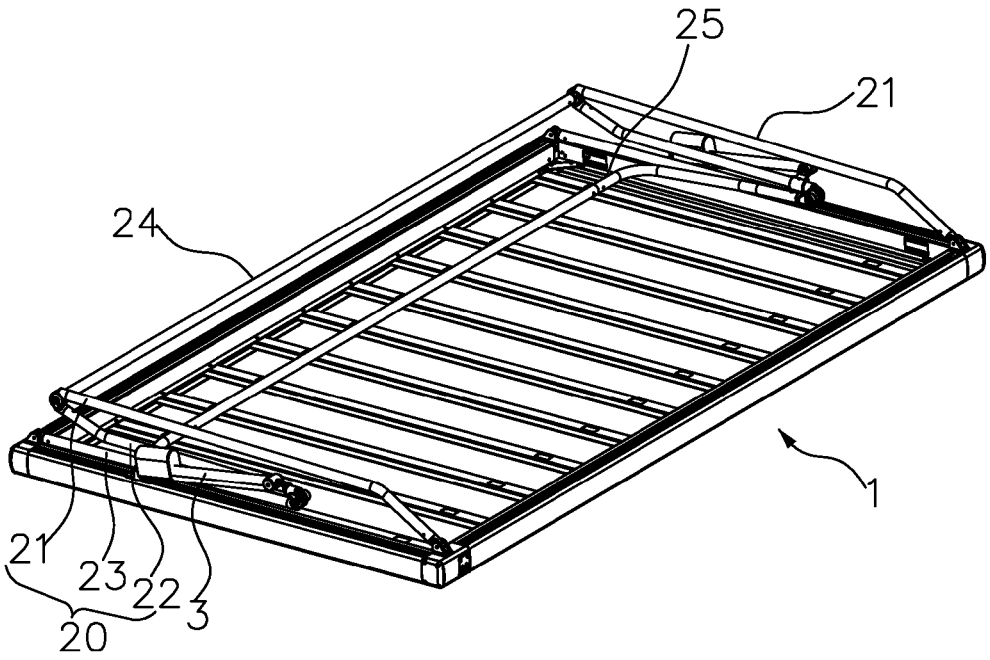
FIG. 2 is a perspective view of a tent frame of the present invention that is taken down.
Figure 3:
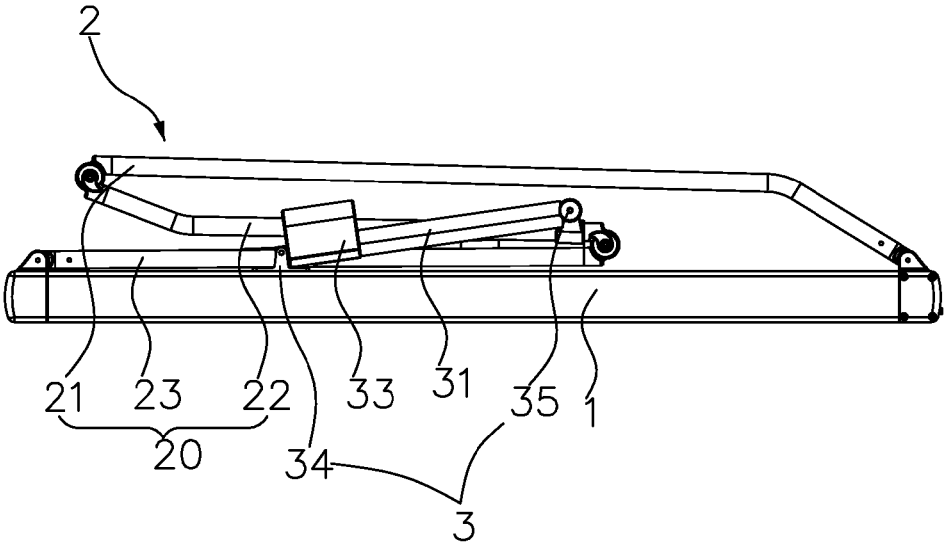
FIG. 3 is a side view of the tent frame of FIG. 1.
Figure 4:
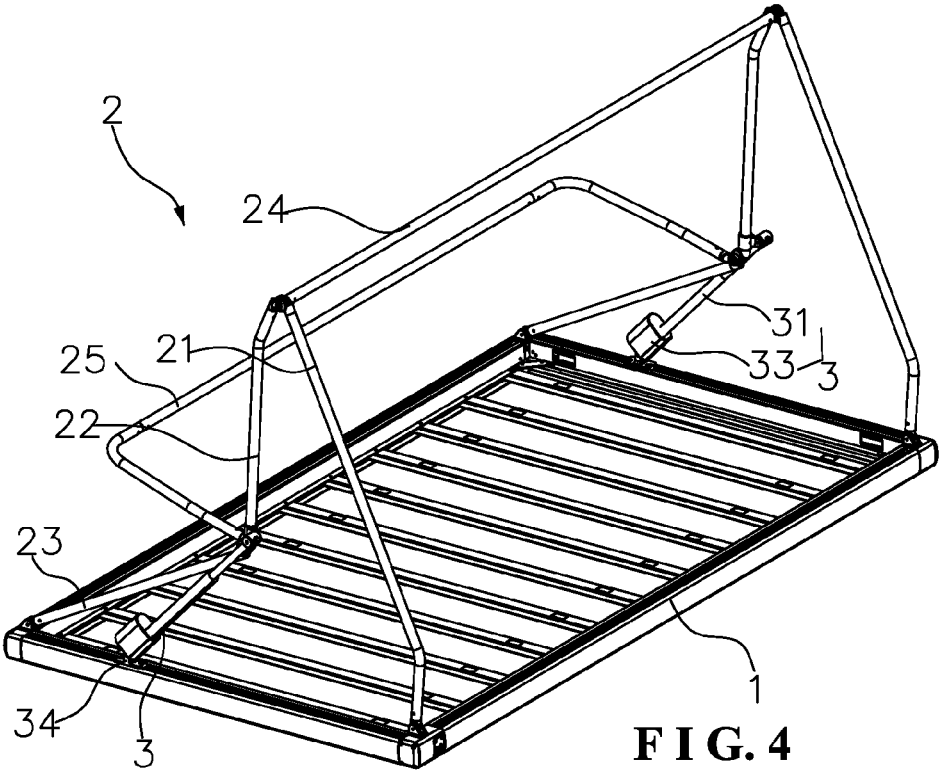
FIG. 4 is a perspective view of the tent frame of FIG. 1 during its expansion.
Figure 5:
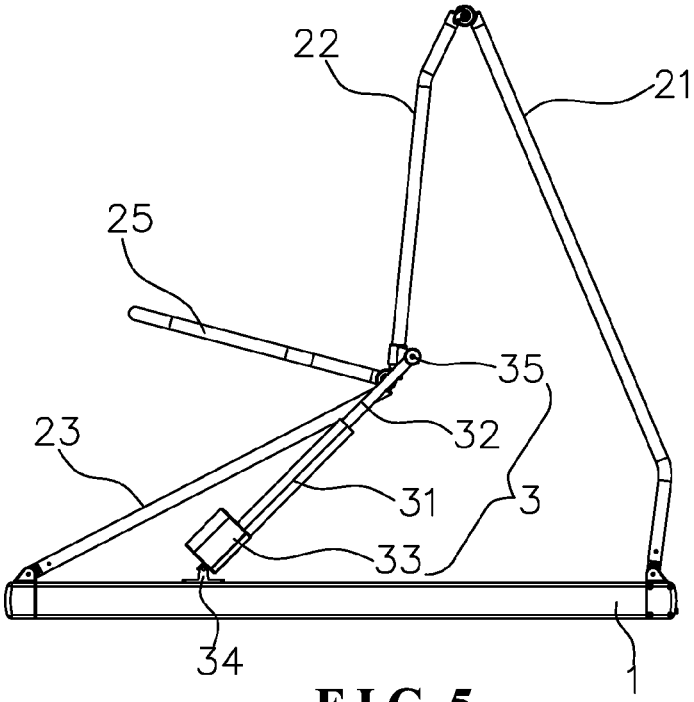
FIG. 5 is a side view of the tent frame of FIG. 4.
Figure 6:
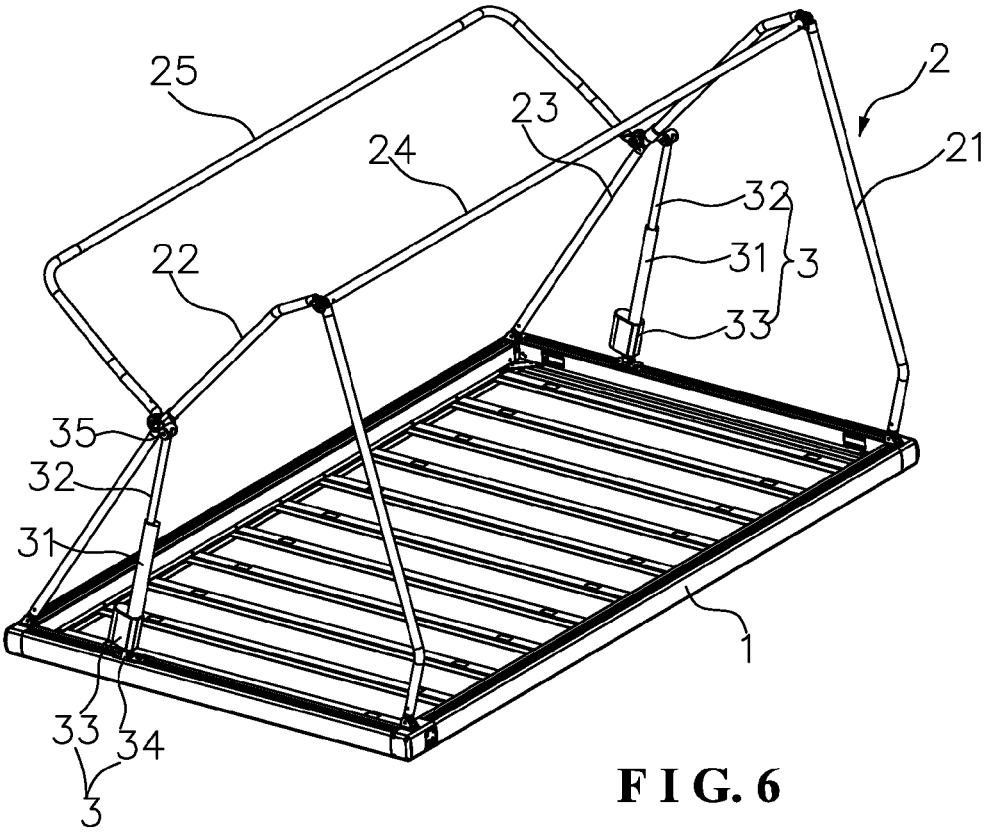
FIG. 6 is a perspective view of a tent frame of the present invention that is now fully put up.
Figure 7:
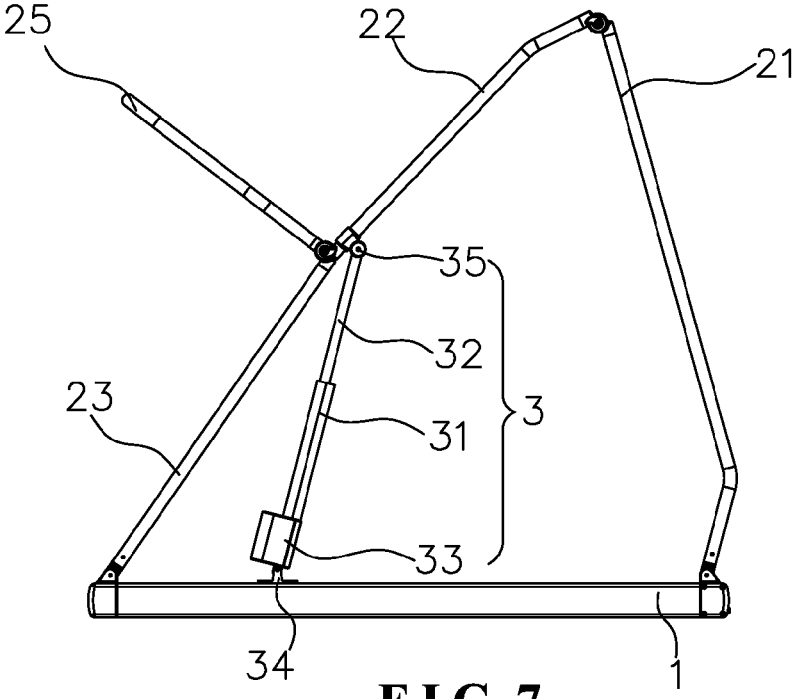
FIG. 7 is a side view of the tent frame of FIG. 6.

Referring to FIG. 2 and FIG. 3, the disclosed tent frame, when taken down, has all the poles staying close with the base 1, and the pushing rod 32 of the rod-pushing mechanism 3 is withdrawn into the fixed sleeve 31. By activating the driving device 33, the pushing rod 32 is driven to extent outward from the fixed sleeve 31. With the extension of the rod-pushing mechanism 3, as shown in FIG. 4 and FIG. 5, the lower supporting pole 23 and the upper supporting pole 22 are pushed to rotate upward and simultaneously draw the supporting pole 21 to rotate upward until the pushing rod 32 achieves its rated reach, where the supporting poles of the tent frame are fully expanded, as shown in FIG. 6 and FIG. 7. To take down the tent, the driving device 33 is operated to move reversely, meaning that it withdraws the pushing rod 32 back to the fixed sleeve 31. At this time, the pushing rod 32 no more props up the lower supporting pole 23 or the upper supporting pole 22, so that pole falls down under the gravity. When all the supporting poles come down, the tent is taken down.

To sum up, the present invention has the rod-pushing mechanism 3 that has the driving device 33 to be pivotally connected to and control each of the two support sets 20 of the tent frame, so as to expand or retract the tent frame by changing the reach of the telescopic rod assembly, i.e. the controlling mechanism or the rod-pushing mechanisms, so the roof-top tent frame is structurally simpler than the existing devices. Moreover, as compared to the prior-art mechanisms, the telescopic rod assembly of the present invention has its path much shorter and has its structural strength improved, so as to ensure the stability and reliability of the pushrod-type tent frame in terms of performance.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A pushrod-type tent frame, comprising
- a base including two front edges and two rear edges disposed at four corners thereof,
- a frame linkage and
- a controlling mechanism;
- the frame linkage including two support sets arranged at two lateral edges of the base and parallel to each other, each said support set having
- a supporting pole,
- an upper supporting pole, shorter in length than the supporting pole, and
- a lower supporting pole, shorter in length than the supporting pole, that are pivotally connected in sequence,
- the supporting pole having an outer end pivotally connected to the front edge of the base, and
- the lower supporting pole having an outer end pivotally connected to the rear edge of the base;
- the controlling mechanism having two rod-pushing mechanisms pivotally connected to the two support sets, respectively,
- each said rod-pushing mechanism including
- a fixed sleeve, non-coaxially connected to a driving device,
- a pushing rod, received in the fixed sleeve for a telescopic movement;
- the driving device for moving the pushing rod with respect to the fixed sleeve, and
- one end pivotally connected to one said lateral edge of the base and an opposite end pivotally connected to the upper supporting pole or the lower supporting pole,
- wherein when the tent frame is unfolded to open up, an acute angle is formed between the supporting pole and the upper supporting pole, simultaneously with an obtuse angle formed below the acute angle, between the upper supporting pole and the lower supporting pole, until the upper supporting pole, the supporting pole and the lower supporting pole stand in a triangle-like shape.

2. The pushrod-type tent frame of claim 1, wherein the fixed sleeve has a lower end pivotally connected to the base via a holder, and the pushing rod has an upper end pivotally connected to the upper supporting pole or the lower supporting pole via a connecting member.

3. The pushrod-type tent frame of claim 1, wherein the fixed sleeve has a lower end pivotally connected to the base via a holder, and the pushing rod has an upper end pivotally connected to a pivot module that pivotally connects the lower supporting pole or the upper supporting pole.

4. The pushrod-type tent frame of claim 1, wherein the frame linkage comprises an auxiliary supporting pole that is a U-shaped member with two ends thereof unidirectionally, pivotally connected to the upper supporting poles, respectively.

5. The pushrod-type tent frame of claim 1, wherein the frame linkage comprises an auxiliary supporting pole that is a U-shaped member with two ends thereof unidirectionally, pivotally connected to two pivot modules each pivotally connecting the lower supporting pole and the upper supporting pole.

* * * * *